US007081069B2

(12) United States Patent
Hsu

(10) Patent No.: US 7,081,069 B2
(45) Date of Patent: Jul. 25, 2006

(54) JOGGING MACHINE HAVING A PLATFORM FOLDING STRUCTURE

(75) Inventor: Long-Chuan Hsu, Tainan Hsien (TW)

(73) Assignee: Shuang Rong Shing Traffic Material Factory Co., Ltd., Tainan Hsien (TW)

( * ) Notice: Subject to any disclaimer, the term of this patent is extended or adjusted under 35 U.S.C. 154(b) by 453 days.

(21) Appl. No.: 10/697,306

(22) Filed: Oct. 31, 2003

(65) Prior Publication Data

US 2005/0096187 A1 May 5, 2005

(51) Int. Cl.
*A63B 22/02* (2006.01)

(52) U.S. Cl. ..... 482/54

(58) Field of Classification Search ..... 482/51–54, 482/104

See application file for complete search history.

(56) References Cited

U.S. PATENT DOCUMENTS

| | | | | |
|---|---|---|---|---|
| 5,823,921 | A * | 10/1998 | Dawson | 482/104 |
| 6,077,198 | A * | 6/2000 | Eschenbach | 482/52 |
| 6,213,919 | B1 * | 4/2001 | Wang et al. | 482/54 |
| 6,830,540 | B1 * | 12/2004 | Watterson et al. | 482/54 |
| 6,890,287 | B1 * | 5/2005 | Chen | 482/54 |
| 6,916,277 | B1 * | 7/2005 | Chen | 482/54 |

* cited by examiner

*Primary Examiner*—Stephen R. Crow
(74) *Attorney, Agent, or Firm*—Rosenberg, Klein & Lee

(57) ABSTRACT

A jogging machine having a platform folding structure includes a base, a platform, a lifter, a pedal, a cable and a block. The lifter includes a cylinder having an engaging end for engagement with the block to maintain the platform in an upright position firmly. By operating the pedal, the cable will pull the block outward so that the platform is released and lowers down slowly.

3 Claims, 7 Drawing Sheets

JOGGING MACHINE HAVING A PLATFORM FOLDING STRUCTURE

FIELD OF THE INVENTION

This invention relates to a jogging machine, and more particularly to a folding structure to secure a platform of the jogging machine at a secure upright position.

BACKGROUND OF THE INVENTION

Living in this modem world people are driven to make a living. People spend more time indoors and there is less time for outdoor life. In order to keep physically in shape, various indoor exercise devices have been invented, one of which is a jogging machine.

However, a conventional jogging machine currently on the market uses a latch to secure a platform at its upright position when not in use to save space. By unlatching the platform will be lowered to a level position for a user to exercise. The latch operation requires the user with one hand holding the platform and the other hand disengaging the latch, which may clamp the user's fingers and cause an accident.

SUMMARY OF THE INVENTION

It is the primary advantage of the present invention to provide a jogging machine having a platform folding structure, which is more secure and safe in operation.

It is another advantage of the present invention to provide a jogging machine having a platform folding structure, which is easy to operate.

DETAILED DESCRIPTION OF THE PREFERRED EMBODIMENT

Figure 1:
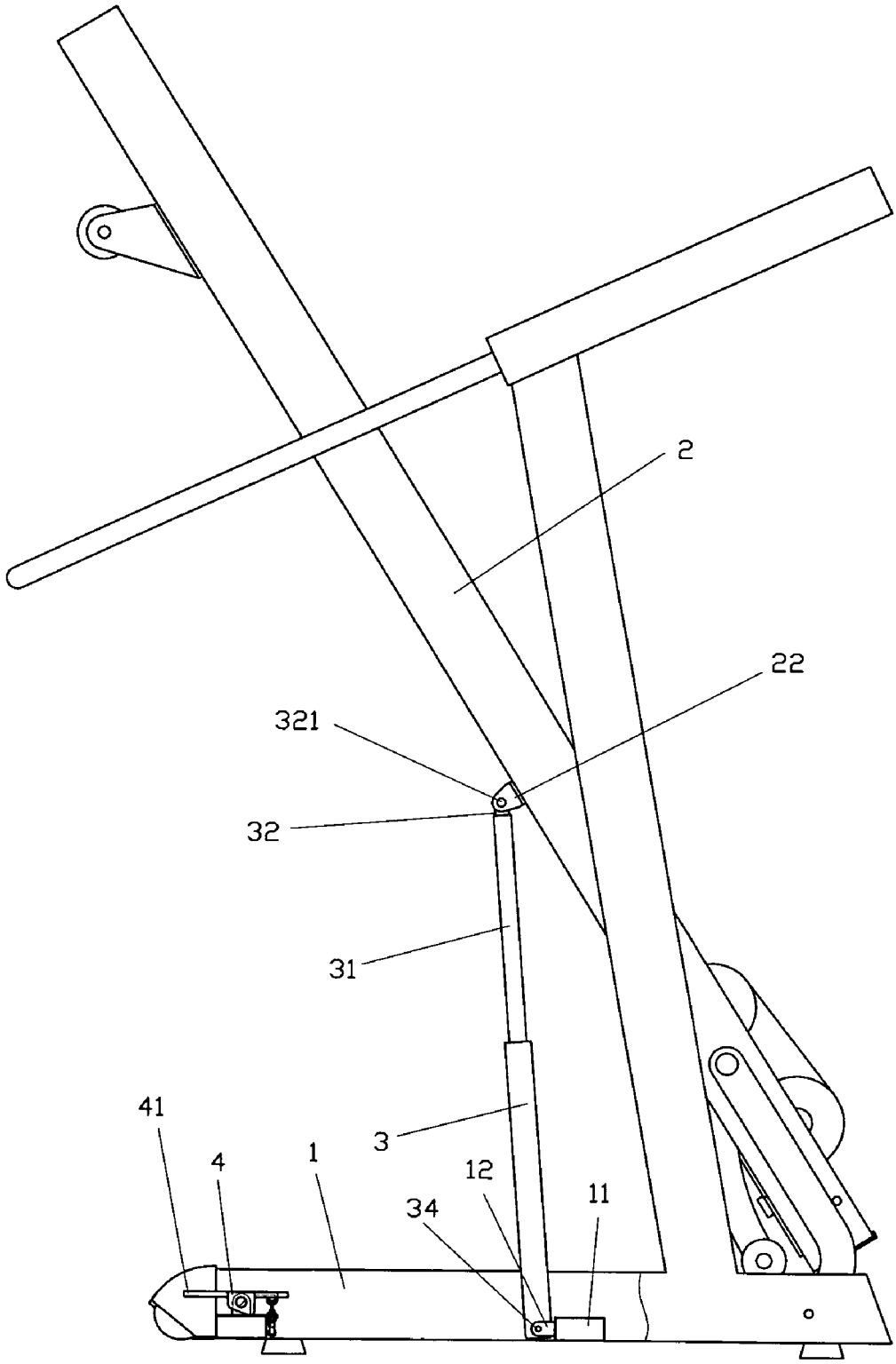
FIG. 1 is a side view of the present invention.

A jogging machine having a platform folding structure of the present invention comprises a base 1, a platform 2, a lifter 3, and a pedal 4.

The base 1 comprises a cross bar 11 at the bottom. The cross bar 11 has a connecting end 12 thereof The platform 2 is pivotally connected to the base 1 and comprises a cross bar 21 at the bottom thereof The cross bar 21 has a connecting end 22 thereof The lifter 3 is pivotally connected between the base 1 and the platform 2. The lifter 3 comprises a cylinder 31. The cylinder 31 has one connecting end 32 pivotally connected to the connecting end 22 of the platform 2 with a fastener

321. The other end of the cylinder 31 has an engaging end 311. The cylinder 31 further comprises a strut 33 which has one end pivotally connected to the connecting end 12 of the base 1 with a fastener 34. The lifter 3 has a fixture 35 along the outer edge and a hole 36 on the wall adapted to receive a block 37 and a spring 371 therein. The block 37 has one end engaged with the engaging end 311 of the lifter 3 and the other end secured with a cable 38. The cable 38 is covered with a sleeve 381 and secured at the fixture 35.

Figure 4:
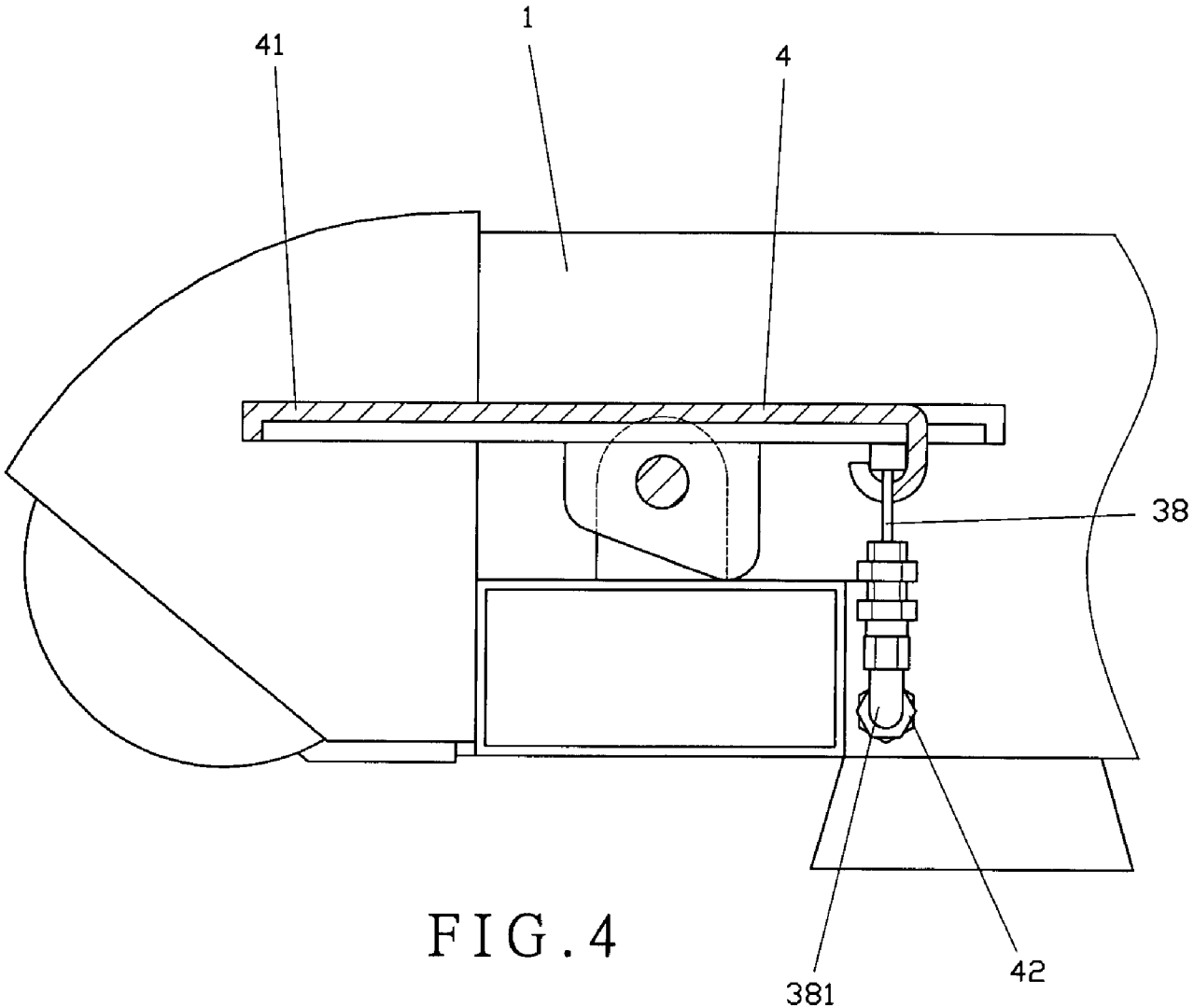
FIG. 4 is an enlarged view of a pedal of the present invention.

As shown in FIG. 4, the pedal 4 is pivotally connected to the base 1. The pedal 4 has a step 41 at one end while the other end is connected with the cable 38. The pedal 4 further comprises a fixture 42 at the bottom thereof The fixture 42 is adapted to secure the other end of the sleeve 381 of the cable 38.

Figure 5:
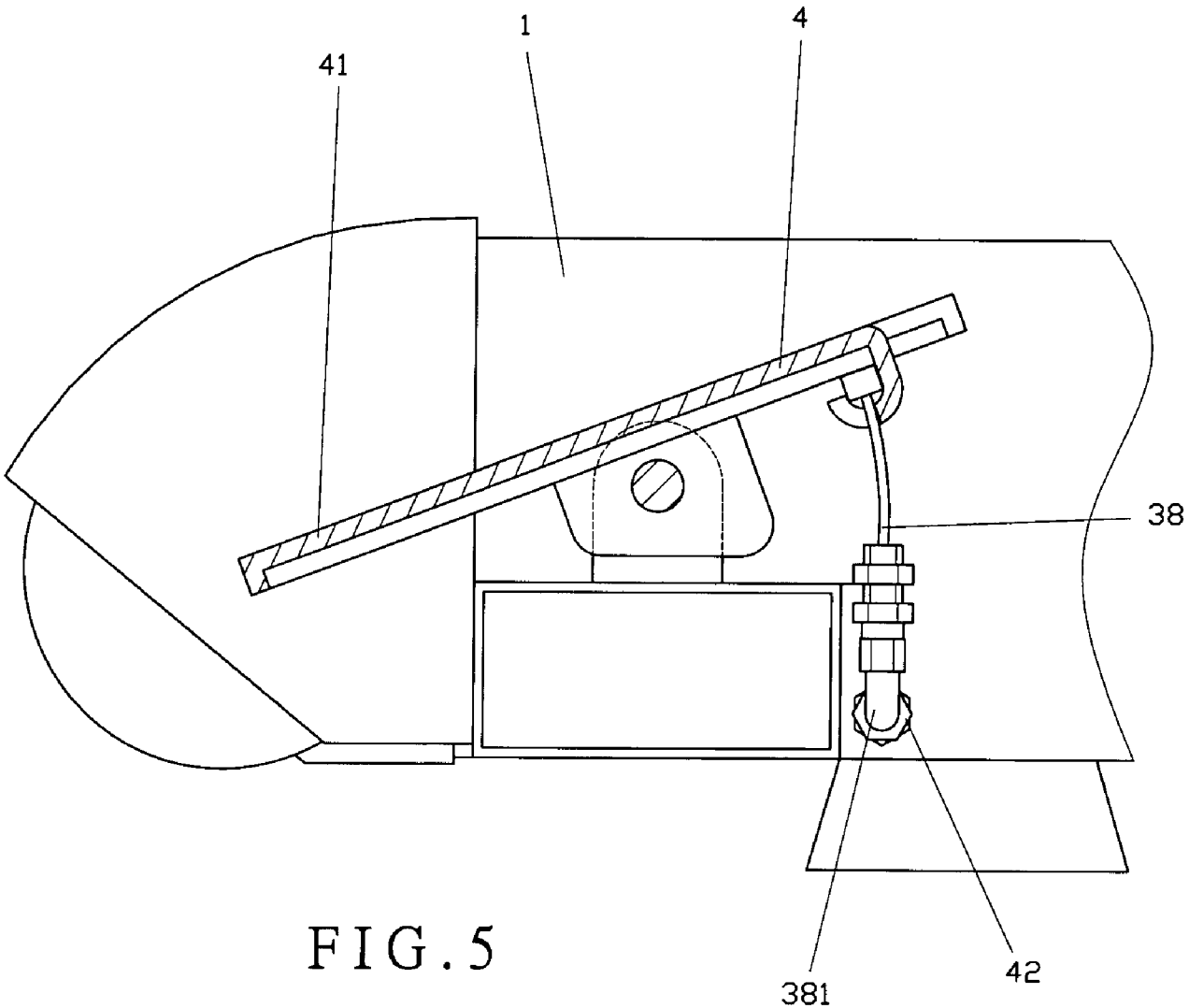
FIG. 5 is a view showing an operation of the pedal of the present invention.
Figure 6:
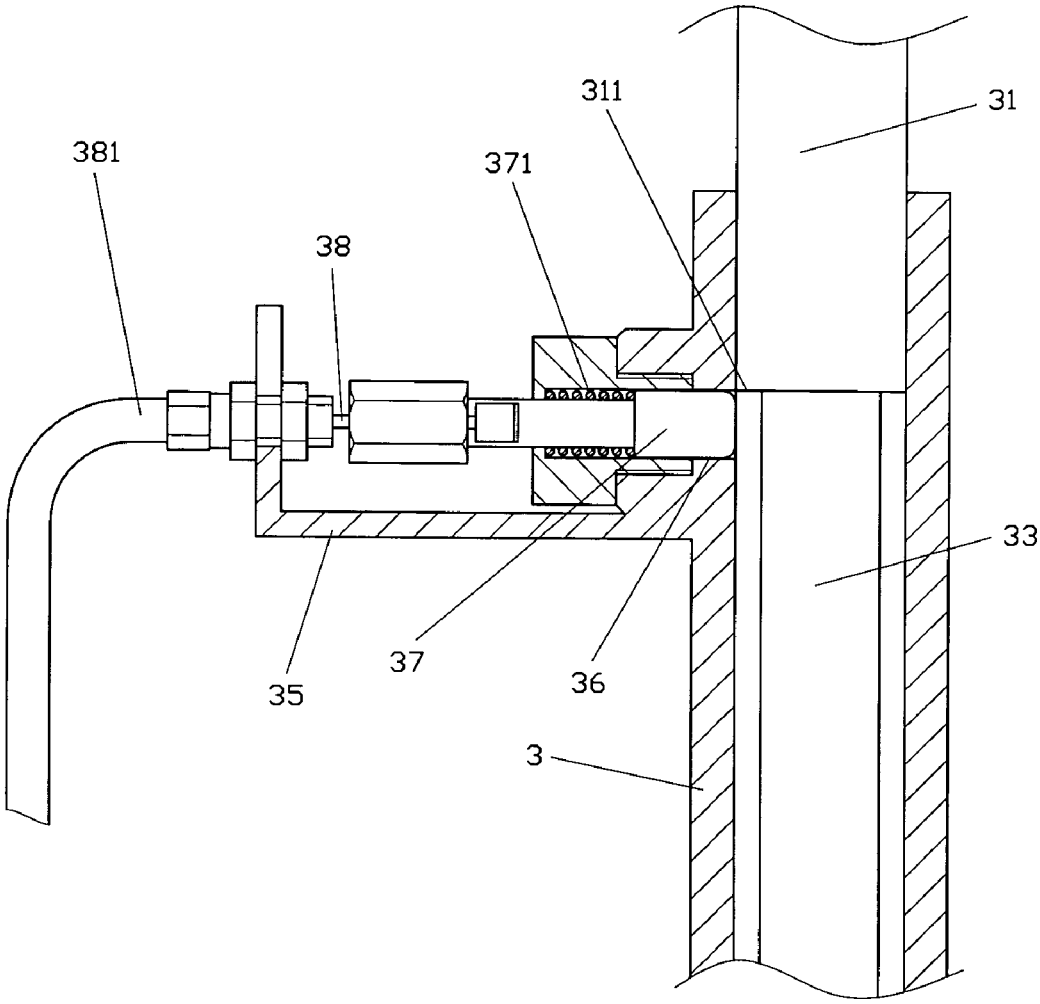
FIG. 6 is a view showing an operation of the block.
Figure 7:
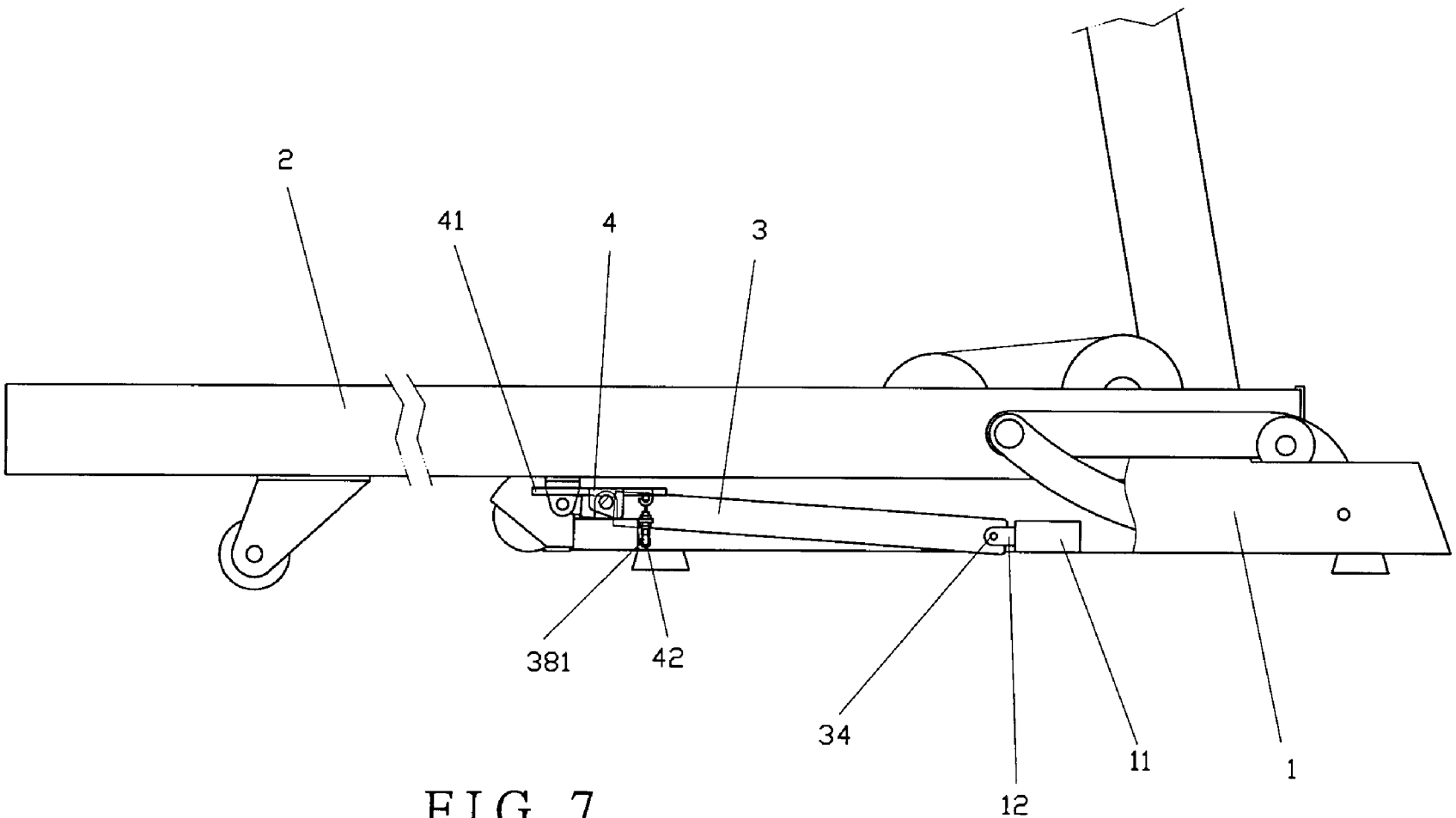
FIG. 7 is a view showing the platform in an operative status.

When a user desires to operate the jogging machine, he/she holds both sides of the platform 2, and then steps on the step 41 of the pedal 4, as shown in FIG. 5. The cable 38 is pulled upwardly to link the block 37 away from the hole 36 and to disengage from the engaging end 311 of the cylinder 31, as shown in FIG. 6. The spring 371 is pressed simultaneously. The platform 2 is pushed to lay down. The block 37 remains in touch with the outer wall of the cylinder 31. The strut 33 of the cylinder 31 of the lifter 3 buffers movement of the platform 2 thereby allowing the platform 2 to move downwards slowly.

Figure 2:
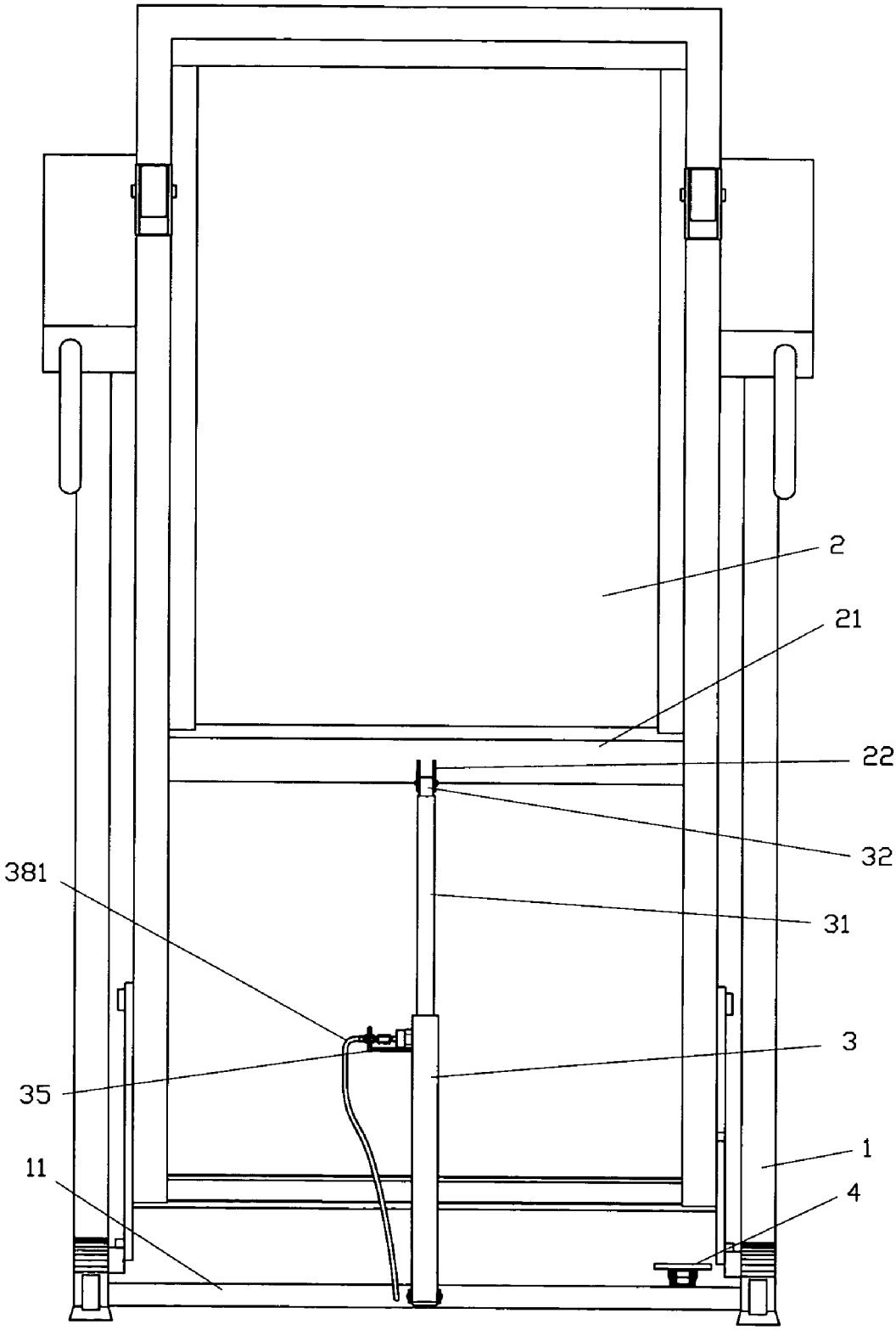
FIG. 2 is a front view of the present invention.
Figure 3:
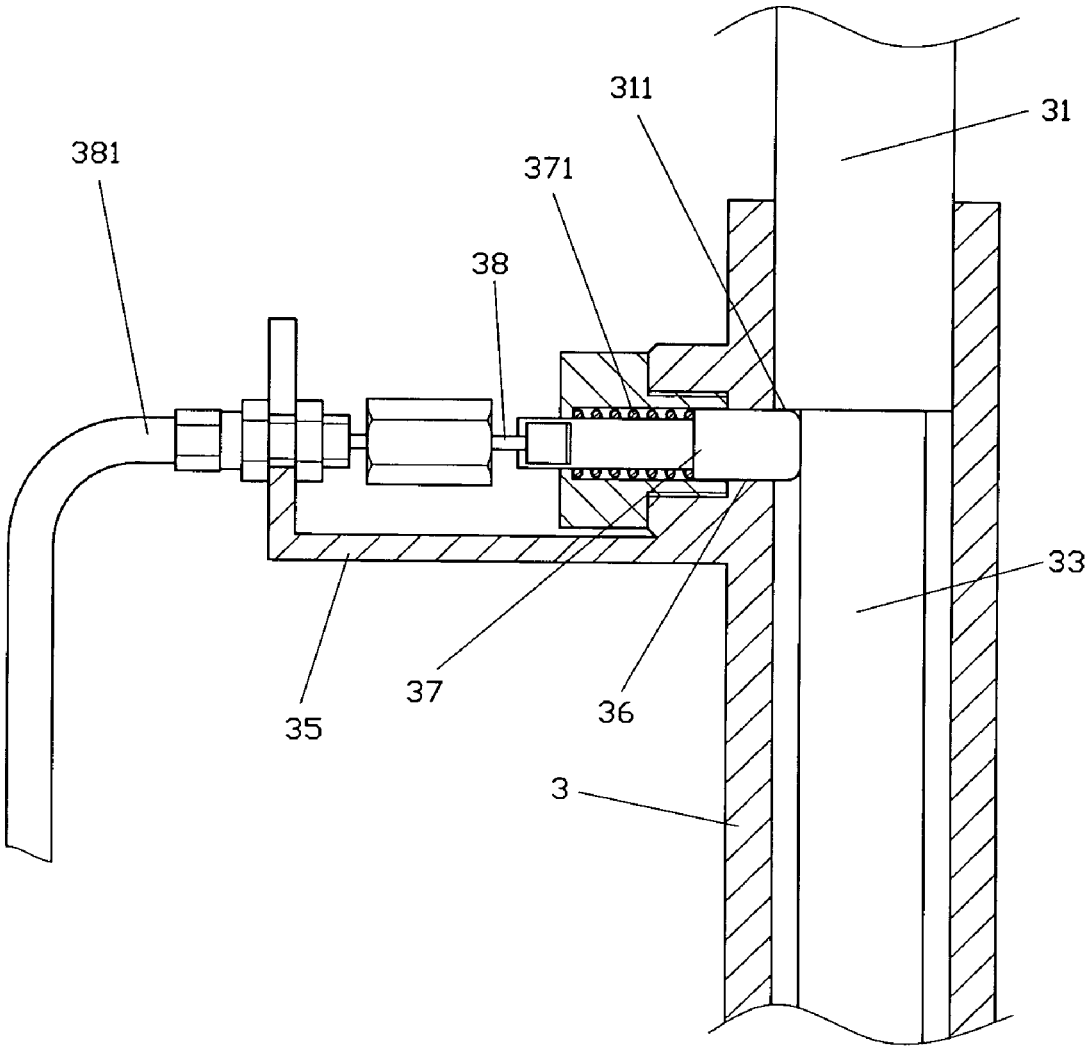
FIG. 3 is an enlarged view of a block of the resent invention.

To fold the platform 2 of the present invention, as shown in FIGS. 1 and 2, the platform 2 is pushed upwardly while the strut 33 of the cylinder 31 of the lifter 3 also provides an assisting force to push the platform 2 upwardly. When the platform 2 reaches to its upright position, the block 37 is urged by the spring 371 to retreat into the hole 36, as shown in FIG. 3. The platform 2 is secured with the base 1 at place.

I claim:

1. A jogging machine having a platform folding structure comprising a base, a platform, and a lifter, said platform being pivotally connected to said base, said lifter being pivotally connected between said base and said platform, said lifter comprising a cylinder having a strut therein, said cylinder having one end pivotally connected to said platform, said strut of said cylinder having one end pivotally connected to said base, and being characterized by:

the jogging machine further comprising a pedal, a cable, a block and a spring, said pedal being pivotally connected to said base, said cylinder comprising an engaging end, said lifter having a hole thereat to receive said block and said spring therein, said block having one end engaged with said engaging end of said cylinder and another end connected with one end of said cable, another end of said cable being secured to said pedal; whereby a user steps on said pedal for pulling the cable and disengaging the block such that the platform is released and displaces downwardly.

2. The jogging machine having a platform folding structure, as recited in claim 1, wherein said lifter has a fixture to secure a sleeve covering said cable.

3. The jogging machine having a platform folding structure, as recited in claim 1, wherein said pedal has a step at one end and a fixture at a bottom end thereof to secure another end of said sleeve of said cable.

* * * * *